US010977928B2

(12) United States Patent
Cruz Huertas et al.

(10) Patent No.: US 10,977,928 B2
(45) Date of Patent: Apr. 13, 2021

(54) SECURITY SYSTEM WITH COOPERATIVE BEHAVIOR

(71) Applicant: INTERNATIONAL BUSINESS MACHINES CORPORATION, Armonk, NY (US)

(72) Inventors: Luis Carlos Cruz Huertas, Heredia (CR); Rick A Hamilton, II, Charlottesville, VA (US); Ninad Sathaye, Pune (IN); Edgar A. Zamora Duran, Heredia (CR)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/852,636

(22) Filed: Apr. 20, 2020

(65) Prior Publication Data

US 2020/0294387 A1 Sep. 17, 2020

Related U.S. Application Data

(63) Continuation of application No. 16/419,125, filed on May 22, 2019, now Pat. No. 10,636,282, which is a (Continued)

(51) Int. Cl.
*G08B 13/00* (2006.01)
*G08B 27/00* (2006.01)

(52) U.S. Cl.
CPC ..... *G08B 27/003* (2013.01); *G08B 13/00* (2013.01)

(58) Field of Classification Search
CPC ..... G08B 27/00; G08B 27/03; G08B 13/00; G08B 19/00
See application file for complete search history.

(56) References Cited

U.S. PATENT DOCUMENTS 7,450,006 B1 * 11/2008 Doyle ..... G08B 13/122 340/10.1
9,013,294 B1 4/2015 Trundle
(Continued)

FOREIGN PATENT DOCUMENTS

WO WO2014121340 A9 8/2014
WO WO2016109062 A9 7/2016

OTHER PUBLICATIONS

Peter Mell et al, The NIST Definition of Cloud Computing, National Institute of Standards and Technology, Publication 800-145, 2011, entire document.

(Continued)

*Primary Examiner* — Toan N Pham
(74) *Attorney, Agent, or Firm* — Patrick J. Daugherty; Daugherty & Del Zoppo Co., LPA

(57) ABSTRACT

Security system devices are configured to retrieve historic first sensor data acquired from a protected area in response to receiving a threat alarm notification from a peer security system that is related to an area monitored by the peer security system, wherein the protected area is different from and geographically separate from the area monitored by the peer security system. The system devise determines that a security threat is indicated for the protected area by assessing the retrieved selection of historic first sensor data as a function of a relation of the threat alarm notification from the peer security system to the protected area, wherein assessing the historic first sensor data without the function of the relation of the threat alarm notification from the peer security system to the protected area results in determining that the security threat is not indicated for the protected area.

20 Claims, 6 Drawing Sheets

Related U.S. Application Data continuation of application No. 15/963,161, filed on Apr. 26, 2018, now abandoned.

(56) References Cited

U.S. PATENT DOCUMENTS

| | | | | |
|---|---|---|---|---|
| 9,552,719 | B1 * | 1/2017 | Dey | G08B 25/008 |
| 2003/0107650 | A1 | 6/2003 | Colmenarez et al. | |
| 2014/0167952 | A1 | 6/2014 | Zhevelev | |
| 2014/0266669 | A1 | 9/2014 | Fadell | |
| 2015/0302725 | A1 | 10/2015 | Sager et al. | |
| 2016/0189529 | A1 | 6/2016 | Lee et al. | |
| 2017/0134895 | A1 | 5/2017 | Rabb | |

OTHER PUBLICATIONS

Edward.-H. Chu et al, Crowdsourcing support system for disaster surveillance and response, IEEE Conference Publication, https://eeexplore.ieee.org/abstract/document/63988171, Sep. 24-27, 2012, Abstract.

* cited by examiner

SECURITY SYSTEM WITH COOPERATIVE BEHAVIOR

BACKGROUND

Aspects of the present invention relate to methods, devices and systems for security alarm systems that assess threat indications from sensor inputs and automatically take loss prevention actions based on said assessments without requiring human review or intervention.

Security alarm systems are generally designed to detect the occurrence of a condition that presents a risk of loss to a protected domain, such as unauthorized entries or other intrusions into secure, protected areas (for example, building, room, display area, safe, yard, property grounds, automobile, closed roadways, etc.). Security alarm systems are used in residential, commercial, industrial, and governmental organization properties for protection against burglary (theft) or property damage, as well as to ensure personal safety protection against intruders.

Security alarm systems may also provide life safety functions, such as fire detection and suppression services, flood warning and prevention, and severe weather warnings and associated loss prevention actions (for example, to trigger the automated closing of storm shutters over windows, fire doors to protect corridors or segment large buildings into smaller, separated areas).

SUMMARY

In one aspect of the present invention, a computerized method for a security system with cooperative behavior includes executing steps on a computer processor. Thus, a computer processor is configured to retrieve a selection of historic first sensor data acquired from a protected area in response to receiving a threat alarm notification from a peer security system that is related to an area monitored by the peer security system, wherein the protected area is different from and geographically separate from the area monitored by the peer security system. The processor determines that a security threat is indicated for the protected area by assessing the retrieved selection of historic first sensor data as a function of a relation of the threat alarm notification from the peer security system to the protected area, wherein assessing the historic first sensor data without the function of the relation of the threat alarm notification from the peer security system to the protected area results in determining that the security threat is not indicated for the protected area.

In another aspect, a system has a hardware processor in circuit communication with a computer readable memory and a computer-readable storage medium having program instructions stored thereon. The processor executes the program instructions stored on the computer-readable storage medium via the computer readable memory and is thereby configured to retrieve a selection of historic first sensor data acquired from a protected area in response to receiving a threat alarm notification from a peer security system that is related to an area monitored by the peer security system, wherein the protected area is different from and geographically separate from the area monitored by the peer security system. The processor determines that a security threat is indicated for the protected area by assessing the retrieved selection of historic first sensor data as a function of a relation of the threat alarm notification from the peer security system to the protected area, wherein assessing the historic first sensor data without the function of the relation of the threat alarm notification from the peer security system to the protected area results in determining that the security threat is not indicated for the protected area.

In another aspect, a computer program product for a security system with cooperative behavior has a computer-readable storage medium with computer readable program code embodied therewith. The computer readable hardware medium is not a transitory signal per se. The computer readable program code includes instructions for execution which cause the processor to retrieve a selection of historic first sensor data acquired from a protected area in response to receiving a threat alarm notification from a peer security system that is related to an area monitored by the peer security system, wherein the protected area is different from and geographically separate from the area monitored by the peer security system. The processor is configured to determine that a security threat is indicated for the protected area by assessing the retrieved selection of historic first sensor data as a function of a relation of the threat alarm notification from the peer security system to the protected area, wherein assessing the historic first sensor data without the function of the relation of the threat alarm notification from the peer security system to the protected area results in determining that the security threat is not indicated for the protected area.

BRIEF DESCRIPTION OF THE DRAWINGS

These and other features of embodiments of the present invention will be more readily understood from the following detailed description of the various aspects of the invention taken in conjunction with the accompanying drawings in which.

DETAILED DESCRIPTION

Figure 1:
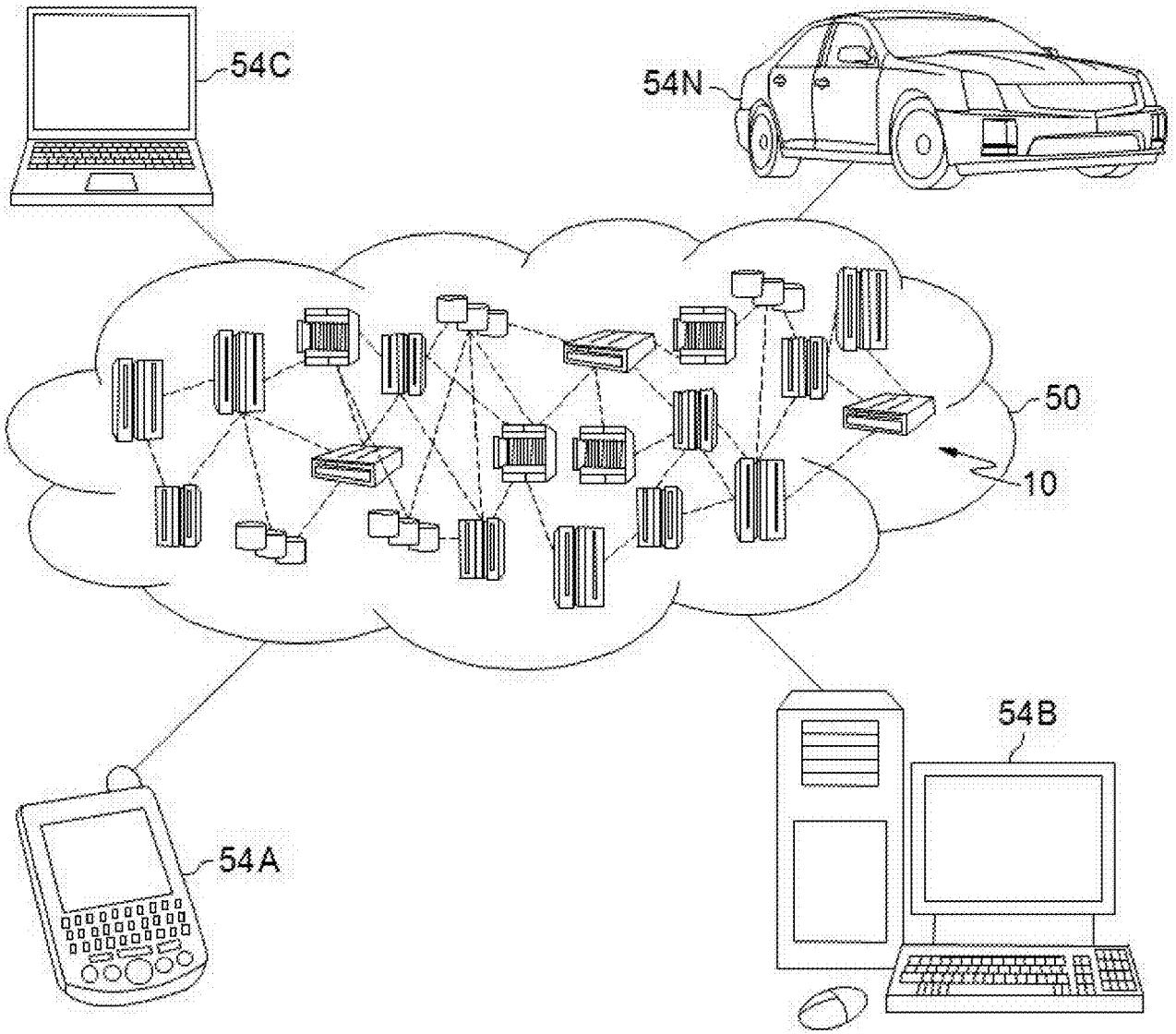
FIG. 1 depicts a cloud computing environment according to an embodiment of the present invention.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD- ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and be rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Referring now to FIG. 1, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 1 are intended to be illustrative only and that computing nodes 10 and cloud computing environment 50 can communicate with any type of computerized device over any type of network and/or network addressable connection (e.g., using a web browser).

Figure 2:
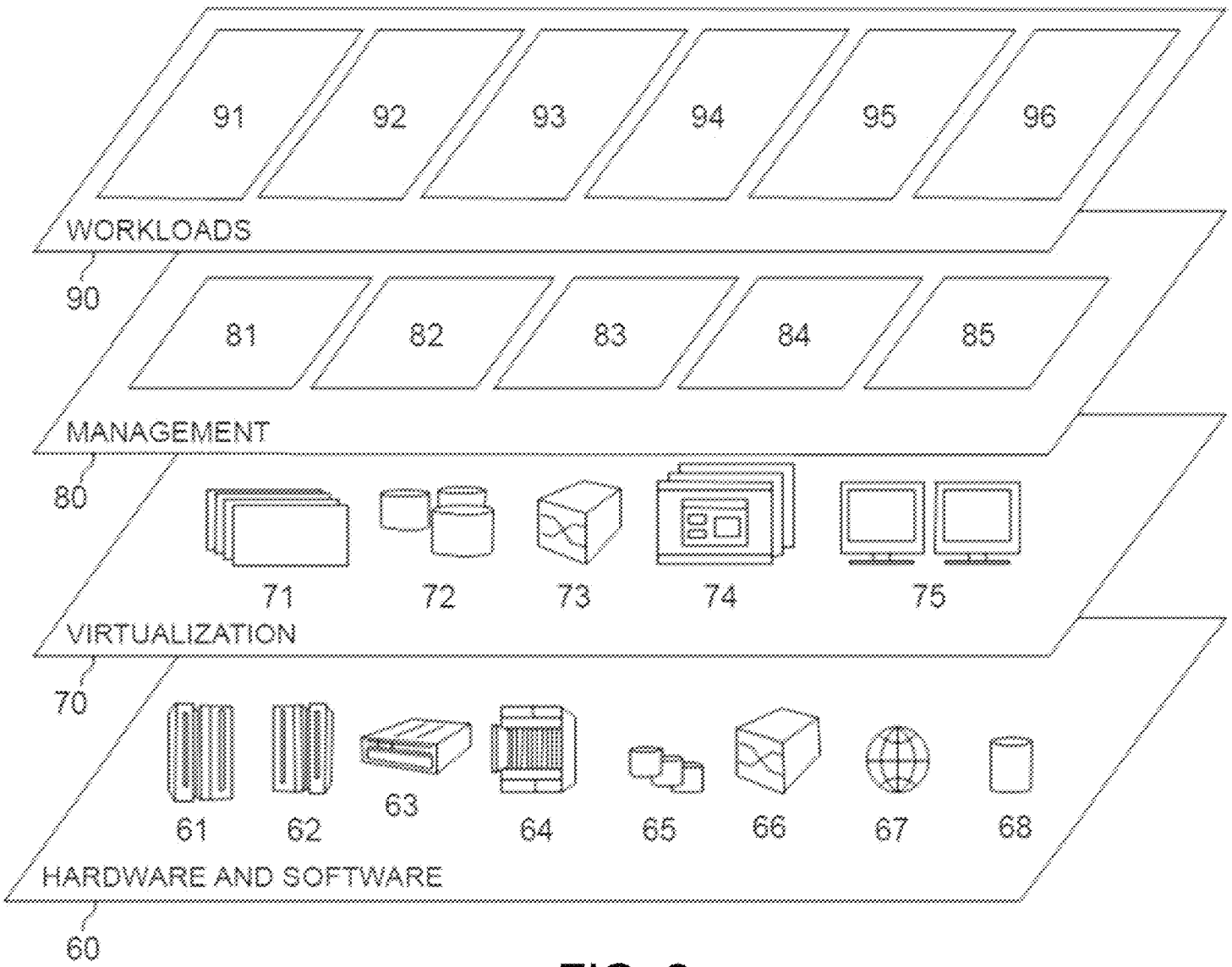
FIG. 2 depicts abstraction model layers according to an embodiment of the present invention.

Referring now to FIG. 2, a set of functional abstraction layers provided by cloud computing environment 50 (FIG. 1) is shown. It should be understood in advance that the components, layers, and functions shown in FIG. 2 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and processing for a security system with cooperative behavior according to aspects of the present invention 96.

Figure 3:
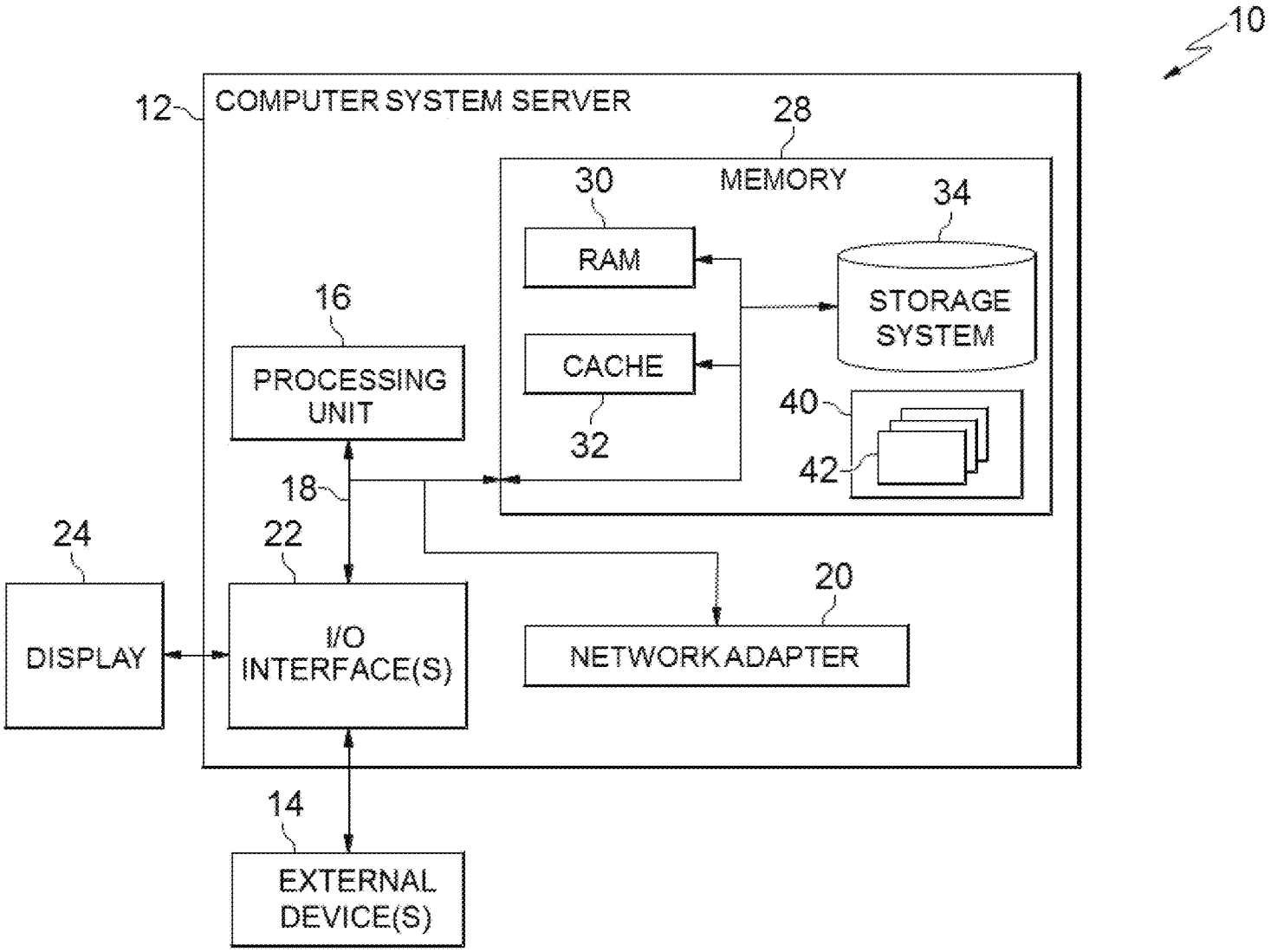
FIG. 3 depicts a computerized aspect according to an embodiment of the present invention.

FIG. 3 is a schematic of an example of a programmable device implementation 10 according to an aspect of the present invention, which may function as a cloud computing node within the cloud computing environment of FIG. 2. Programmable device implementation 10 is only one example of a suitable implementation and is not intended to suggest any limitation as to the scope of use or functionality of embodiments of the invention described herein. Regardless, programmable device implementation 10 is capable of being implemented and/or performing any of the functionality set forth hereinabove.

A computer system/server 12 is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

The computer system/server 12 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 4:
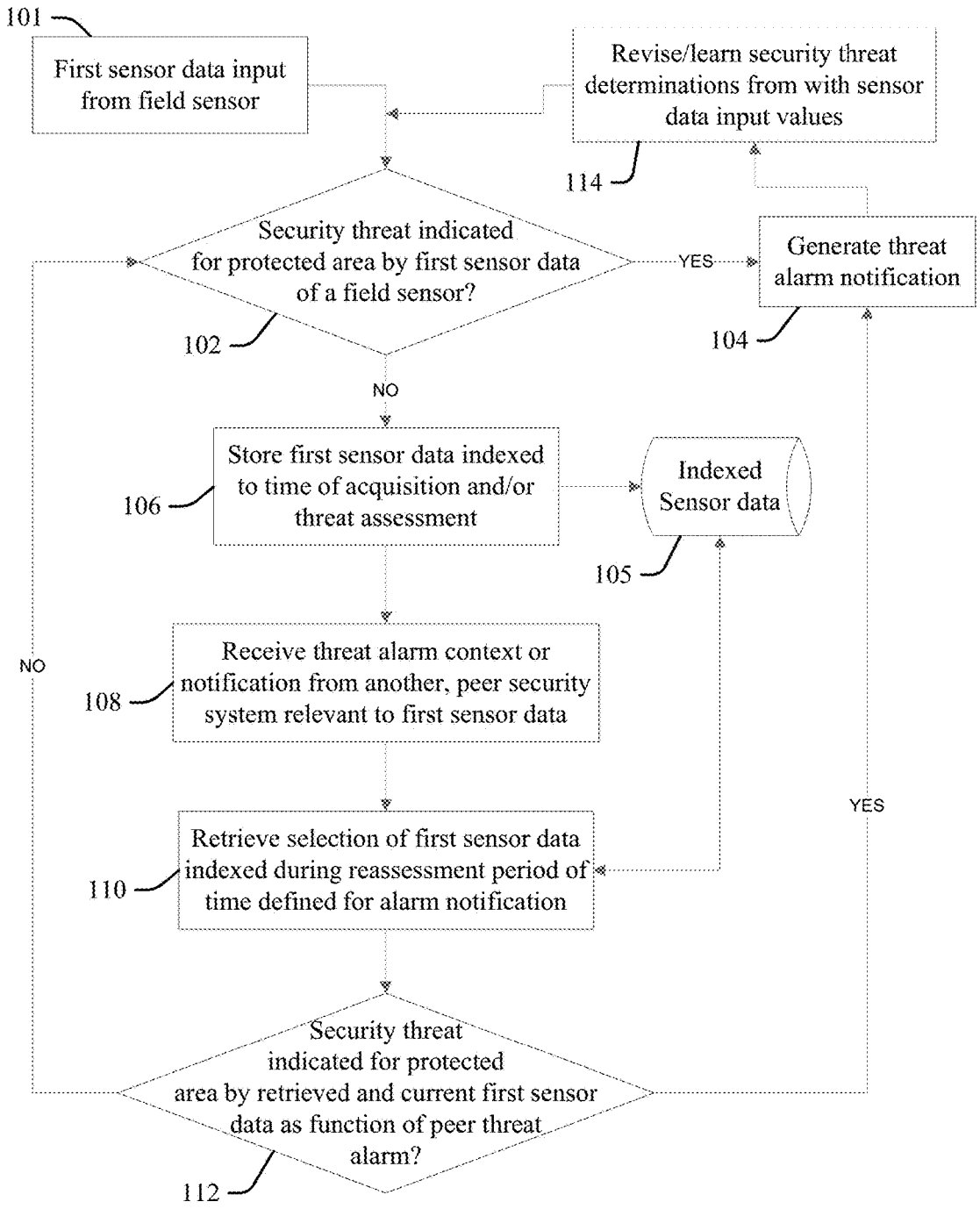
FIG. 4 is a flow chart illustration of an embodiment of the present invention.

FIG. 4 illustrates a security system with cooperative behavior according to the present invention. At 102 a processor configured according to an aspect of the present invention (the "configured processor") determines whether a security threat is indicated with respect to a designated or protected area by first sensor data 101 reported by a first field sensor (whether a threshold alarm condition is met by a value of the first sensor data), and thereby triggers the generation of an appropriate alarm at 104 if the threshold condition (the "YES" condition) is met. A variety of field sensors and associated first sensor data may be considered, and illustrative but not limiting or exhaustive examples include motion data sensed (detected) by a motion detector; object image data extracted from the field of view of a camera that matches an object mask defined for a person;

microphone sound inputs determined to match footfall profiles or other noises associated with human or other animal activity; air quality sensors may detect carbon dioxide indicative of emissions of an unauthorized human or animal present within a restricted area; water monitors may detect rising floodwaters or changing flow rate or volume values indicative of flood or tsunami threat, or theft or diversion of water; etc. A variety of protected, monitored areas may be defined by physical or electronic, virtual fencing or other boundaries, and illustrative but not limiting or exhaustive examples include a room, office space, hallway, or floor area demarcated by walls and doors, gates and window closures, a building, a fenced-in yard area and/or immediately adjacent areas outside of the fencing defining the protected area, etc. Still other protected areas and associated security sensor inputs appropriate for consideration and determinations at 102 that result in generation of an alarm at 104 will be apparent to one skilled in the art.

If the alarm condition threshold is not met at 102, then at 106 the configured processor stores the first sensor data into a storage device or resource 105 (for example, a cloud storage service) indexed to time of acquisition of the first sensor data, or to the threat assessment made with respect to the first sensor data at 102, and continues to monitor and assess the first sensor at 102 for meeting a threshold alarm condition for the protected area.

At 108 the configured processor receives a threat context or alarm notification from another, "peer" security system from other (second) sensor data from another different (second) sensor that is related to or otherwise relevant to the first sensor data and/or the protected area monitored or otherwise protected by the security system. More particularly, the received alarm may be relevant to the first sensor data as being triggered by a similar type of sensor data, wherein a relative proximity of their respective protected areas to each other indicates that it is more likely that a similar alarm condition is occurring in the protected area. Additionally, the type of the peer alarm may indicate that it is more likely that a similar alarm condition is occurring in the protected area as a function of proximity or other relation of the respective protected areas to each other, regardless of the respective types of sensor data.

The term "peer" as applied to security systems herein will be understood to convey a relationship between the configured processor and the other, peer security system within a linked group of multiple (two or more), different and autonomous security systems, wherein each have the capability to independently determine the presence of an alarm condition based on sensor data alone, and upon alarm determination process outputs from others of the peer systems communicated to them via networked communications. Generally each of the peer systems makes independent alarm or threat determinations via the process of FIG. 4, though in some embodiments the configured processor or another of the peer systems linked to the configured processor may be designated as or function as a central security system, wherein each of other ones of the configured processor and other peer systems provide individual alarm or threat determination inputs to the designated central security system for use in a centralized alarm determination process, wherein the centralized system may distribute a central alarm or threat determination back to each of the peer systems for use, including in revising their own threat or alarm determinations as described herein.

Threat context data considered at 108 includes regional security information relevant to a geographic area or domain protected by the system. For example, a peer or central security system may notify each of the other peer systems within the group of a raised level of security, such as in the case of a potential security threat or planned event context which has historically resulted in higher number security incidences in an applicable region, wherein a central or peer system may responsively lower (or "adjust") their current security or threat assessment thresholds used to trigger an alarm or security incidence determination or planned event. Context data includes relevant data feeds from news feeds and social networks. Illustrative but not limiting or exhaustive examples include an increase in the frequency or amounts of burglaries or other loss incidents reported or commented upon within a geographic region that includes an area protected by the security system; travel or regional advisories issued by public safety officials as to recent occurrences of fraudulent offers for home improvement made by persons that are linked to subsequent theft or burglary; reports of vandalism or property damage within a protected area; flash flooding, strong storms or other severe weather warnings issued by private or governmental weather services that impact a protected area and increase risk of loss from flooding, fire, or power outages, etc.; surges in vehicular or pedestrian traffic, or heavy loading on mass transportation options, expected due to mass assembly events (concerts, first day of school, etc.) scheduled for a protected region, or that may negatively impact response times to security alarms, wherein alarm determination thresholds may be lowered to trigger earlier responses by public safety or private security to protected properties in order to abate threat conditions at incipient phases or conditions; and still other relevant contextual information will be apparent to one skilled in the art.

Thus, in response to receiving the threat context or alarm notification from the peer security system at 108, at 110 the configured processor retrieves a selection of historic first sensor data from the storage device 105 that is indexed during a reassessment period of time defined as prior to the peer alarm or context notification. The configured processor retrieves first sensor data indexed over some period of time prior to the receipt or generation of the peer alarm/context notification (one minute, five minutes, ten minutes, or any other appropriate period of time), and at 112 reassesses the historic, indexed data, along with current first sensor data input from the field sensor, as a function of a context of the peer alarm or other threat condition, in order to determine whether a security threat is indicated for the protected area as a function of the alarm/enhance threat context. If so, then the configured processor generates a threat alarm notification at 104; else, the configured processor returns to process 102 to continue to monitor the first sensor data.

The context of a peer alarm includes a relation of the area monitored by the peer security system to the protected area, which is different from and geographically separate from the area monitored by the peer security system. Reassessment of the first sensor data 112, current or historic, may generally incorporate an increased weighting, value or likelihood that the first sensor data meets a threshold condition, due to the peer system alarm condition. In some embodiments, the aspect increases the determined weighting, alarm value or threat likelihood of the historic data to meet a threshold alarm condition in inverse proportion to a proximity distance value of the protected area to the area monitored by the peer security system, or a time difference between the time of receiving the threat alarm notification from the peer security system and a time of occurrence indexed to the historic first sensor data.

At 114 the configured processor learns or revises security threat determinations derived from the first sensor data input values 101 as a function of the threats generated by reassessment at 112 in a feedback process, for use in subsequent threat assessments based on the first sensor data inputs 101 at 102 and 112.

More particularly, aspects of the present invention link individual security systems and processes to form a cognitive security system that accesses security threats across an area (neighborhood, campus, related facilities geographically remote from each other, etc.) by analyzing deployed sensor data as a function of other security feeds or threat levels as obtained or determined by other, trusted security systems within a group of peer security systems (in the neighborhood, covering different parts of a campus or geographically remote locations, etc.). The aspects enable one individual system to "connects the dots" of inferences made by considering the separate threat determinations of the other peer systems, to thereby identify non-obvious security threats, those that would not be recognized by the system based solely on its own sensor data and security determinations.

By considering the additional determinations of the peer systems, aspects are enabled to trigger a variety of alerts with regard to its own domain and to the protected domains of the other peer systems, to prevent loss within the other domain or inform the other peer systems about possible security incidence occurrences that affect their areas of protection.

The process at 114 defines a learning model that uses continuous feedback based on accuracy levels of estimation of threat assessment at 102 and 112, wherein individual, disparate peer systems learn threat assessment as a function of the audible, visual and/or chemical sensor norms and conditions for their protected places, including as a function of time of day, and day of week. Through this training each peer system is enabled to spot deviations from the norms indicative of threat conditions that would otherwise be counter-indicated by their own sensor data considered alone, and to communicate this learned threat determination to other peer systems for their use in enhancing security within their own domains.

In some aspects, threat determinations or appropriate actions taken therefrom may be based on consensus: established in response to determining at 114 that a threshold number or percentage of the peer systems have determined a threat condition exists (meets thresholds) via considering their own sensor data and the sensor data or threat determinations of others of the peer systems. Further, the feedback process at 114 may define this threat determination for use by each of the other peer systems, inclusive of those that did not make the same threat determination (thereby increasing the sensitivity or likelihood that the other peer systems that did not determine that a threat condition is occurring will determine or recognize the threat in the future). Thus, when a host system sends its threat and alarm determinations and other security data over to a peer system or central system for deeper processing, the receiving system is enabled to get additional insights from the peer system security data that are useful for a deeper analysis of current security threats in order to make an appropriate alarm determination. Further, it is noted that learning models, processes or capacities implemented in the individual, peer security systems may not be identical: accordingly, in some embodiments central or peer systems "out-source" security data for a deeper analysis or scanning to one or more other ones of the peer systems that have more processing or sensory resources, or better or specialized processing capacity, for better analysis with respect to a specific data sets, thereby expanding the scope of their own abilities in determining and recognizing threat and alarm situations.

Figure 5:
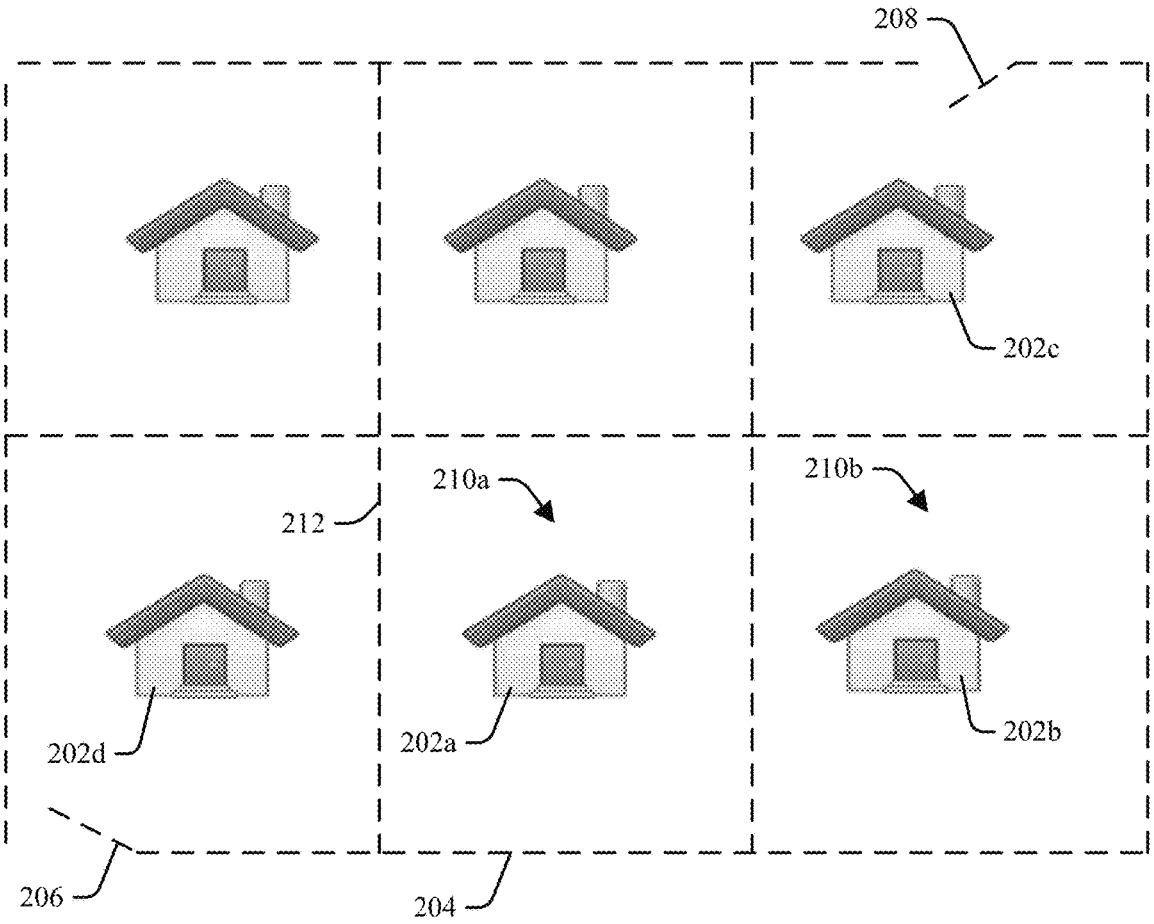
FIG. 5 is a block diagram illustration of an implantation of the present invention.

FIG. 5 illustrates one example wherein a configured processor provides security system services for a first house 202*a* of a development neighborhood of individual houses 202 that are all located within an area restricted to residents and their invitees, demarcated and encompassed by a perimeter security fence 204 with ingress and egress gates 206 and 208, wherein the first sensor data is a sound monitor configured to pick-up sounds within and around the yard 210*a* of the first house 202*a*, wherein the individual yards 210 of the houses 202 are demarcated by the perimeter fence 204 and individual yard fencing segments 212.

Thus, at 102 the configured processor processes sound data picked up by the first sensor at 11:00 PM, compares it to a knowledge base of sound level and signature profiles, and determines that the sound is most likely that made by a small animal (cat, raccoon, etc.) walking on a deck within the yard 210*a* of the first house 202*a* (for example, as a function of level of sound, cadence and rhythm or other sound profile, time of night and location, frequency of such sounds sensed recently, etc.), and therefore determines that a threat is not indicated and progresses to the process at 106 (to index the sound data to the time of detection within the indexed sensor data device or resource 105).

At 108 the configured processor receives notice of a threat alarm notification from the peer security system of a neighboring house 202*b* that is generated at 11:05 PM that a human intruder is likely within the enclosed yard 210*b* of the neighboring house (for example, generated from processing motion detector sensor data, or from sound sensor data that is indicative of a human-sized animal within the yard of the neighbor house). In response, at 110 the configured processor retrieves all first sensor data from the storage resource 105 indexed for 30 minutes prior to the peer threat alarm time of 11:05 PM and at 112 reprocesses the first sensor data as a function of the peer threat alarm: by increasing the likelihood or weighting of sound signals picked up by the first sensor to favor a determination that any such sounds are made by a human, and not a small animal. Accordingly, reprocessing of the first sensor sound signals indexed at 11:00 PM (during the 30-minute look-back period) in the context of the peer threat alarm (at a revised weighting or bias triggered by notification of the peer alarm) results in the configured processor determining at 112 that said sound signals were likely made by an unauthorized human walking across the deck or other portion of the yard 210*a* and therefore trespassing within the yard 210*a* of the first house 202*a*, rather than a small animal, triggering a burglar alarm notification at 104 (for example, turning on yard lights within the yard 210*a*, or also within the neighboring yard 210*b* or within others or all of the other yards 210, sounding alarm bells, informing a local police department with an image captured by security system cameras at 10:55 PM along with the GPS locations of the image or camera used to capture the image, alert homeowners or residents via electronic messaging, etc.)

Accordingly, the individual security system for the house 202*a* determines security threats for the house 202*a* by analyzing in real-time data reported by a variety of field sensors for the house 202*a* and its yard 210*a*, as well as data reported by the trusted neighborhood security systems of the other houses 202*b*, 202*c*, etc., and/or the raw data of their respective sensors. Thus, when any individual security system for any of the houses 202 in the neighborhood assesses an incident as a potential security threat, it notifies this determination to the other, "buddy systems" in the security network of each of the other houses 202, wherein the notification may trigger each of the individual security systems to run deeper analytics of their sensor security feeds for a stipulated time frame. For example, if the security system for house 202*b* reports a potential threat at 12:00 AM, all of the other neighborhood systems of the houses 202*a*, 202*c*, 202*d*, etc., run deep level analytics for near real-time data (say between 11:50 AM to 1:00 AM), to capture any security incidents that the respective real-time or streaming analytics component may have missed.

Figure 6:
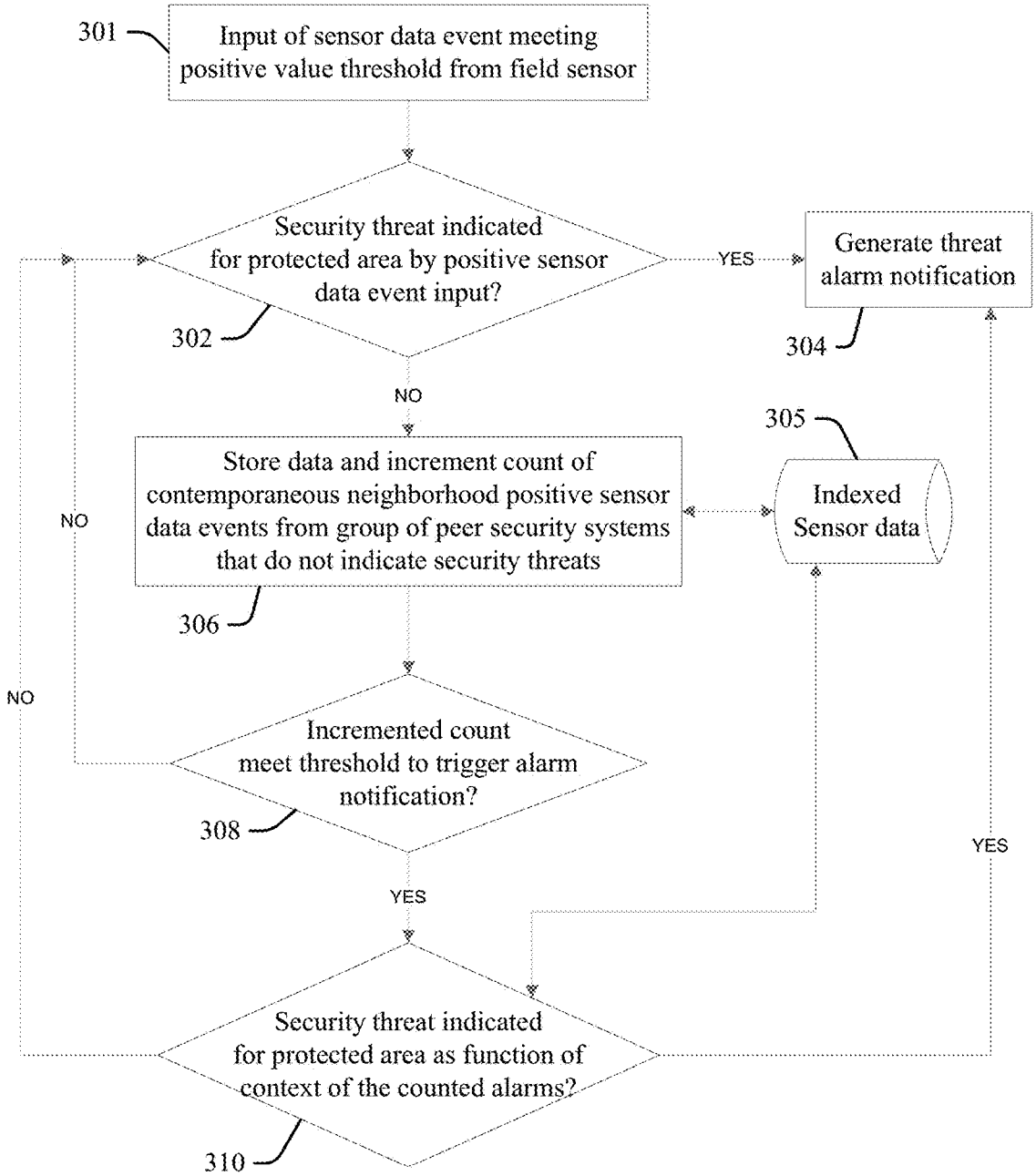
FIG. 6 is a flow chart illustration of another embodiment of the present invention.

FIG. 6 illustrates another embodiment of the present invention, wherein at 302 a processor configured according to an aspect of the present invention (the "configured processor") determines whether a security threat is indicated with respect to a protected area by first sensor data 301 reported by a first field sensor (whether a threshold alarm condition is met by a value of the first sensor data), and thereby triggers the generation of an appropriate alarm at 304 if the threshold condition (the "YES" condition) is met.

If the alarm condition threshold is not met at 302, then at 306 the configured processor stores the first sensor data into a storage device or resource 305 (for example, a cloud storage service) indexed to time of acquisition of the first sensor data, or to the threat assessment made with respect to the first sensor data at 302, and increments a total count of contemporaneous neighborhood positive sensor data events from groups of peer security systems that do not indicate security threats (wherein the other, peer systems have determined that the events did not meet threshold threat levels to trigger an alarm).

At 308 the configured processor determines whether the incremented count meets a threshold. If the incremented count does not meet the threshold at 308, the configured processor continues to the monitor and assess the first sensor data at 302 for meeting a threshold alarm condition for the protected area.

If the incremented count meets the threshold at 308, then at 310 the configured processor reassesses the security threat presented by the sensor data 301 as a context of the contemporaneous occurrence of multiple non-alarm events reflected by the incremented count (in real-time, and as indexed within the event storage device/resource 305) that each individually fail to trigger alarm conditions by the peer systems reporting the events. If a security threat is indicated at 308, then the configured processor triggers an appropriate alarm at 304; otherwise, the configured processor returns to 302 to continue to the monitor and assess the first sensor data for meeting a threshold alarm condition for the protected area.

The event count may be incremented at 306 by each peer system within a group of systems in response to reporting an event that does not meet alarm criteria, and in some aspects also in response to reporting an alarm. More particularly, the received alarms or non-alarms are related to each by time: they are contemporaneous within a time period chosen or determined to indicate a strength of relation of the events to each other (for example, within the last 5 seconds, 5 minutes, 30 minutes, 24 hours, etc.). Additionally, to reduce noise within the data or false alarms incrementing may be based on the type of the peer alarm (for example, only sound sensor events may increment the count, or motion data, or image data, etc.), or threshold distance proximity may be required, etc.

Illustration of the process of FIG. 6 is provided by the following variation of the example fact pattern discussed with respect to FIG. 5, wherein the security system of house 202*c* reports that image data for the gate 208 shows an unrecognized person entering the community premises @10:55 PM, and said the system determines that this does not raise an alarm by itself, and increments the value of a peer system event counter at 306 (FIG. 6). Independently, the configured processor of the security system of house 202*a* processes sound data picked up by the sound sensor at 11:00 PM and determines that the sound is most likely that made by a small animal and therefore determines that a threat is not indicated, and also increments the value of said counter at 306. Similarly, the peer security system of the neighboring house 202*b* providing the notice of the threat alarm notification at 11:05 PM (that a human intruder is likely within the enclosed yard 210*b* of the neighboring house) also increments the value of the event counter.

In this example, these two non-alarm events and the notice of the threat alarm notification from the peer security system of the neighboring house 202*b* are contemporaneous for this counter (for example, they each occur within 10 minutes of each other), and therefore the incremented count value is at least three: if this meets the threshold value, then further review of the security threat by the first house 202*a* security system is made as a context of the three events at 310, which may result in triggering an alarm at 304, even though the event data 301 considered alone does not trigger the alarm at 302.

Aspects of the present invention provide advantages over prior art security devices, including a more reliable detection of a security threat by considering community, peer security device feedback. For example, an individual neighboring system may help identify a real threat that is only viewed as a minor variation from sensor data norms by another, host security system, prompting the host system to reassess domain conditions (for example, re-process image data from a security camera feed over a five minute time period before a possible security incident occurrence, to make a revised assessment as to the likelihood that that incident poses a security threat).

The cooperative, cognitive determinations made in gross by a group of peer security devices provide a more accurate threat assessment relative to individual systems, helping actuaries and insurance companies to more accurately determine loss exposures and associated insurance premiums and other costs. Thus, a cooperative network defined by a group of peer security systems trained by the processes of FIG. 4 or 6, in combination with a good security response handling system, may reduce losses relative to prior art, individual and autonomous security device deployments, resulting in corresponding reductions in insurance premium costs.

Aspects of the present invention present a scalable security infrastructure that uses feedback from community system inferred threats for more accurate determination of threats relative to prior art systems. Individual security devices function as crowd-sourcing smart objects within a network of peers, with each cognitive element responsible for providing cognitive analysis to the collective, wherein threat assessment may be made by polling the assessments of multiple, independent machine learning systems, wherein consensus agreement of their individual determinations may be used to define security threats.

The terminology used herein is for describing aspects only and is not intended to be limiting of the invention. As used herein, the singular forms "a", "an" and "the" are intended to include the plural forms as well, unless the context clearly indicates otherwise. It will be further understood that the terms "include" and "including" when used in this specification specify the presence of stated features, integers, steps, operations, elements, and/or components, but do not preclude the presence or addition of one or more other features, integers, steps, operations, elements, components, and/or groups thereof. Certain examples and elements described in the present specification, including in the claims, and as illustrated in the figures, may be distinguished, or otherwise identified from others by unique adjectives (e.g. a "first" element distinguished from another "second" or "third" of a plurality of elements, a "primary" distinguished from a "secondary" one or "another" item, etc.) Such identifying adjectives are generally used to reduce confusion or uncertainty, and are not to be construed to limit the claims to any specific illustrated element or embodiment, or to imply any precedence, ordering or ranking of any claim elements, limitations, or process steps.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-implemented method for a security system with cooperative behavior, the method comprising executing on a computer processor:

in response to receiving a threat alarm notification from a peer security system that is related to an area monitored by the peer security system, retrieving a selection of historic first sensor data acquired from a protected area, wherein the protected area is different from and geographically separate from the area monitored by the peer security system; and determining that a security threat is indicated for the protected area by assessing the retrieved selection of historic first sensor data as a function of a relation of the threat alarm notification from the peer security system to the protected area;

wherein assessing the historic first sensor data without the function of the relation of the threat alarm notification from the peer security system to the protected area results in determining that the security threat is not indicated for the protected area.

2. The method of claim 1, wherein the retrieving the selection of historic first sensor data comprises retrieving historic first sensor data indexed to a reassessment period of time extending prior to a time of receiving the threat alarm notification from the peer security system.

3. The method of claim 1, wherein the threat alarm notification from the peer security system comprises a regional alert that is relevant to the protected area and that is selected from the group consisting of a news article, a social network posting, a weather services notice, a travel advisory and a public safety agency bulletin.

4. The method of claim 1, wherein the determining that the security threat is indicated for the protected area comprises assessing the retrieved selection of historic first sensor data as a function of a similarity of a type of the historic first sensor data to a type of other sensor data that is used by the peer security system to generate the threat alarm notification; and wherein the historic first sensor data is generated in association with the protected area by a first sensor, and the other sensor data is generated in association with the area monitored by the peer security system by a peer system sensor that is different from and geographically remote from the first sensor.

5. The method of claim 1, further comprising:

revising a threat condition threshold as a function of feedback from the determining that the security threat is indicated for the protected area by assessing the retrieved selection of historic first sensor data as the function of the relation of the threat alarm notification from the peer security system to the protected area;

wherein implementation of the revised threat condition threshold in assessing the historic first sensor data without the function of the relation of the threat alarm notification from the peer security system to the protected area results in determining that the security threat is indicated for the protected area.

6. The method of claim 5, wherein the relation of the threat alarm notification from the peer security system to the protected area comprises a total count of contemporaneous sensor data events that are reported from each of a group of peer security systems, the method further comprising:

in response to determining that the security threat is not indicated for the protected area by assessing the historic first sensor data without the function of the relation of the threat alarm notification from the peer security system to the protected area, incrementing the total count of contemporaneous sensor data events; and determining that the security threat is indicated for the protected area in response to determining that the incremented total count of contemporaneous sensor data events meets a threshold value.

7. The method of claim 1, wherein the determining that the security threat indicated for the protected area comprises assessing the retrieved selection of historic first sensor data as a function of a proximity of the protected area to the area monitored by the peer security system.

8. The method of claim 7, wherein the determining that the security threat indicated for the protected area comprises increasing a likelihood that the retrieved selection of historic first sensor data to meet a threshold condition in inverse proportion to an amount that is selected from the group consisting of a proximity distance value of the protected area to the area monitored by the peer security system, and a time difference between the time of receiving the threat alarm notification from the peer security system and a time of occurrence indexed to the historic first sensor data.

9. The method of claim 1, further comprising:

integrating computer-readable program code into a computer system comprising a processor, a computer readable memory in circuit communication with the processor, and a computer readable storage medium in circuit communication with the processor; and wherein the processor executes program code instructions stored on the computer-readable storage medium via the computer readable memory and thereby performs the retrieving the selection of historic first sensor data acquired from the protected area in response to receiving the threat alarm notification, and the determining that the security threat is indicated for the protected area by assessing the retrieved selection of historic first sensor data as the function of the relation of the threat alarm notification from the peer security system to the protected area.

10. The method of claim 9, wherein the computer-readable program code is provided as a service in a cloud environment.

11. A system, comprising:

a processor;

a computer readable memory in circuit communication with the processor; and a computer readable storage medium in circuit communication with the processor;

wherein the processor executes program instructions stored on the computer-readable storage medium via the computer readable memory and thereby:

in response to receiving a threat alarm notification from a peer security system that is related to an area monitored by the peer security system, retrieves a selection of historic first sensor data acquired from a protected area, wherein the protected area is different from and geographically separate from the area monitored by the peer security system; and determines that a security threat is indicated for the protected area by assessing the retrieved selection of historic first sensor data as a function of a relation of the threat alarm notification from the peer security system to the protected area;

wherein assessing the historic first sensor data without the function of the relation of the threat alarm notification from the peer security system to the protected area results in determining that the security threat is not indicated for the protected area.

12. The system of claim 11, wherein the processor executes the program instructions stored on the computer-readable storage medium via the computer readable memory and thereby retrieves the selection of historic first sensor data by retrieving historic first sensor data indexed to a reassessment period of time extending prior to a time of receiving the threat alarm notification from the peer security system.

13. The system of claim 11, wherein the threat alarm notification from the peer security system comprises a regional alert that is relevant to the protected area and that is selected from the group consisting of a news article, a social network posting, a weather services notice, a travel advisory and a public safety agency bulletin.

14. The system of claim 11, wherein the processor executes the program instructions stored on the computer-readable storage medium via the computer readable memory and thereby determines that the security threat is indicated for the protected area by assessing the retrieved selection of historic first sensor data as a function of a similarity of a type of the historic first sensor data to a type of other sensor data that is used by the peer security system to generate the threat alarm notification; and wherein the historic first sensor data is generated in association with the protected area by a first sensor, and the other sensor data is generated in association with the area monitored by the peer security system by a peer system sensor that is different from and geographically remote from the first sensor.

15. The system of claim 11, wherein the processor executes the program instructions stored on the computer-readable storage medium via the computer readable memory and thereby revises a threat condition threshold as a function of feedback from determining that the security threat is indicated for the protected area by assessing the retrieved selection of historic first sensor data as the function of the relation of the threat alarm notification from the peer security system to the protected area;

wherein implementation of the revised threat condition threshold in assessing the historic first sensor data without the function of the relation of the threat alarm notification from the peer security system to the protected area results in determining that the security threat is indicated for the protected area.

16. The system of claim 15, wherein the relation of the threat alarm notification from the peer security system to the protected area comprises a total count of contemporaneous sensor data events that are reported from each of a group of peer security systems; and wherein the processor executes the program instructions stored on the computer-readable storage medium via the computer readable memory and thereby:

in response to determining that the security threat is not indicated for the protected area by assessing the historic first sensor data without the function of the relation of the threat alarm notification from the peer security system to the protected area, increments the total count of contemporaneous sensor data events; and determines that the security threat is indicated for the protected area in response to determining that the incremented total count of contemporaneous sensor data events meets a threshold value.

17. A computer program product for a security system with cooperative behavior, the computer program product comprising:

a computer readable storage medium having computer readable program code embodied therewith, wherein the computer readable storage medium is not a transitory signal per se, the computer readable program code comprising instructions for execution by a processor that cause the processor to:

in response to receiving a threat alarm notification from a peer security system that is related to an area monitored by the peer security system, retrieve a selection of historic first sensor data acquired from a protected area, wherein the protected area is different from and geographically separate from the area monitored by the peer security system; and determine that a security threat is indicated for the protected area by assessing the retrieved selection of historic first sensor data as a function of a relation of the threat alarm notification from the peer security system to the protected area;

wherein assessing the historic first sensor data without the function of the relation of the threat alarm notification from the peer security system to the protected area results in determining that the security threat is not indicated for the protected area.

18. The computer program product of claim 17, wherein the computer readable program code instructions for execution by the processor further cause the processor to determine that the security threat is indicated for the protected area by assessing the retrieved selection of historic first sensor data as a function of a similarity of a type of the historic first sensor data to a type of other sensor data that is used by the peer security system to generate the threat alarm notification; and wherein the historic first sensor data is generated in association with the protected area by a first sensor, and the other sensor data is generated in association with the area monitored by the peer security system by a peer system sensor that is different from and geographically remote from the first sensor.

19. The computer program product of claim 17, wherein the computer readable program code instructions for execution by the processor further cause the processor to revise a threat condition threshold as a function of feedback from determining that the security threat is indicated for the protected area by assessing the retrieved selection of historic first sensor data as the function of the relation of the threat alarm notification from the peer security system to the protected area;

wherein implementation of the revised threat condition threshold in assessing the historic first sensor data without the function of the relation of the threat alarm notification from the peer security system to the protected area results in determining that the security threat is indicated for the protected area.

20. The computer program product of claim 17, wherein the relation of the threat alarm notification from the peer security system to the protected area comprises a total count of contemporaneous sensor data events that are reported from each of a group of peer security systems; and wherein the computer readable program code instructions for execution by the processor further cause the processor to:

in response to determining that the security threat is not indicated for the protected area by assessing the historic first sensor data without the function of the relation of the threat alarm notification from the peer security system to the protected area, increment the total count of contemporaneous sensor data events; and determine that the security threat is indicated for the protected area in response to determining that the incremented total count of contemporaneous sensor data events meets a threshold value.

* * * * *